US010685607B2

(12) United States Patent
Mao et al.

(10) Patent No.: US 10,685,607 B2
(45) Date of Patent: Jun. 16, 2020

(54) ADJUSTMENT METHOD FOR DISPLAY DE-MURA

(71) Applicant: InnoLux Corporation, Miao-Li County (TW)

(72) Inventors: Li-Wei Mao, Miao-Li County (TW); Ming-Chia Shih, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 7 days.

(21) Appl. No.: 15/791,946

(22) Filed: Oct. 24, 2017

(65) Prior Publication Data

US 2018/0122309 A1 May 3, 2018

Related U.S. Application Data

(60) Provisional application No. 62/416,679, filed on Nov. 2, 2016.

(30) Foreign Application Priority Data

Feb. 21, 2017 (CN) ..... 2017 1 0093620

(51) Int. Cl.
*G09G 3/34* (2006.01)
*G09G 3/36* (2006.01)

(52) U.S. Cl.
CPC ..... *G09G 3/3413* (2013.01); *G09G 3/342* (2013.01); *G09G 3/3607* (2013.01); *G09G 2320/0233* (2013.01); *G09G 2320/0242* (2013.01)

(58) Field of Classification Search
CPC .... G09G 3/3413; G09G 3/342; G09G 3/3607; G09G 2320/0233; G09G 2320/0242
See application file for complete search history.

(56) References Cited

U.S. PATENT DOCUMENTS 7,050,074 B1 * 5/2006 Koyama ..... G09G 3/2003 345/589
7,671,542 B2 3/2010 Chang et al.
(Continued)

FOREIGN PATENT DOCUMENTS

CN 101384120 A 3/2009
CN 102332242 A 1/2012

OTHER PUBLICATIONS

Chinese language office action dated Jul. 15, 2019, issued in application No. CN 201710093620.8.

*Primary Examiner* — Md Saiful A Siddiqui
(74) *Attorney, Agent, or Firm* — McClure, Qualey & Rodack, LLP

(57) ABSTRACT

An adjustment method, which is adapted in a display including a plurality of pixels and a plurality of backlight illuminants, includes: inputting an image signal with a single chromaticity and luminance to the display; adjusting a set of a backlight red gray-level luminance, a backlight green gray-level luminance, and a backlight blue gray-level luminance for each of the illuminants, and the difference of the luminance of the backlight illuminants is between 0 and 10%; and adjusting a set of a pixel red gray-level value, a pixel green gray-level value, and a pixel blue gray-level value for each of the pixels, and the difference of the luminance of the pixels is between 0% and 5%.

7 Claims, 3 Drawing Sheets

(56) References Cited

U.S. PATENT DOCUMENTS

2009/0015541 A1* 1/2009 Honbo ..... G09G 3/342
345/102
2009/0058879 A1* 3/2009 Li ..... G09G 3/3607
345/600
2009/0116232 A1* 5/2009 Chang ..... H05B 33/0818
362/231
2009/0189841 A1* 7/2009 Chen ..... G09G 3/3413
345/102
2010/0085338 A1* 4/2010 Miguchi ..... G02F 1/133609
345/207
2011/0285763 A1* 11/2011 Bassi ..... G06T 5/008
345/694
2013/0293567 A1* 11/2013 Shigeta ..... G01J 3/506
345/589
2015/0332444 A1* 11/2015 Tsuda ..... H04N 1/407
382/167
2017/0256192 A1* 9/2017 Knepper ..... G09G 3/2003

* cited by examiner

ADJUSTMENT METHOD FOR DISPLAY DE-MURA

CROSS REFERENCE TO RELATED APPLICATIONS

This application claims the benefit of U.S. Provisional Application No. 62/416,679, filed on Nov. 2, 2016, the entirety of which is incorporated by reference herein.

This Application claims priority of China Patent Application No. 201710093620.8, filed on Feb. 21, 2017, the entirety of which is incorporated by reference herein.

BACKGROUND OF THE INVENTION

Field of the Invention

The disclosure relates generally to methods for adjusting displays to improve the non-uniformity of the chromaticity and luminance.

Description of the Related Art

Mura is a phenomenon wherein various screen traces are caused by non-uniform luminance in a display. The most simplified determination method is to turn ON a white screen or another high grey-level screen in a dark room and then to carefully observe the screen from various angles. The liquid-crystal display will show all kinds of Mura with all kinds of defects in the manufacturing process.

Mura doesn't interfere with usage, and is merely a matter of taste problem by human eyes. However, panel manufacturers treat panels with Mura as secondary products to sell at a lower price, which may seriously affect profits. Therefore, we need to propose an adjustment method to deal with the non-uniformity of the chromaticity and luminance of a display.

BRIEF SUMMARY OF THE INVENTION

In an embodiment, an adjustment method, which is adapted to a display comprising a plurality of pixels and a plurality of backlight illuminants, comprises: inputting an image signal with a single chromaticity and luminance to the display; adjusting a set of a backlight red gray-level luminance, a backlight green gray-level luminance, and a backlight blue gray-level luminance for each of the illuminants, and the difference of the luminance of the backlight illuminants is between 0% and 10%; and adjusting a set of a pixel red gray-level value, a pixel green gray-level value, and a pixel blue gray-level value for each of the pixels, and the difference of the luminance of the pixels is between 0% and 5%.

In an embodiment, a display comprises a plurality of pixels and a controller. Each of the pixels comprises a pixel red gray-level value, a pixel green gray-level value, and a pixel blue gray-level value. Each of the pixels adjusts a set of the pixel red gray-level value, the pixel green gray-level value, and the pixel blue gray-level value according to a corresponding pixel signal, in which the pixel signal corresponds to an image signal with a signal chromaticity and signal luminance. The controller generates the pixel signal, and at least two sets of the pixel red gray-level value, the pixel green gray-level value, and the pixel blue gray-level value are different from each other.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
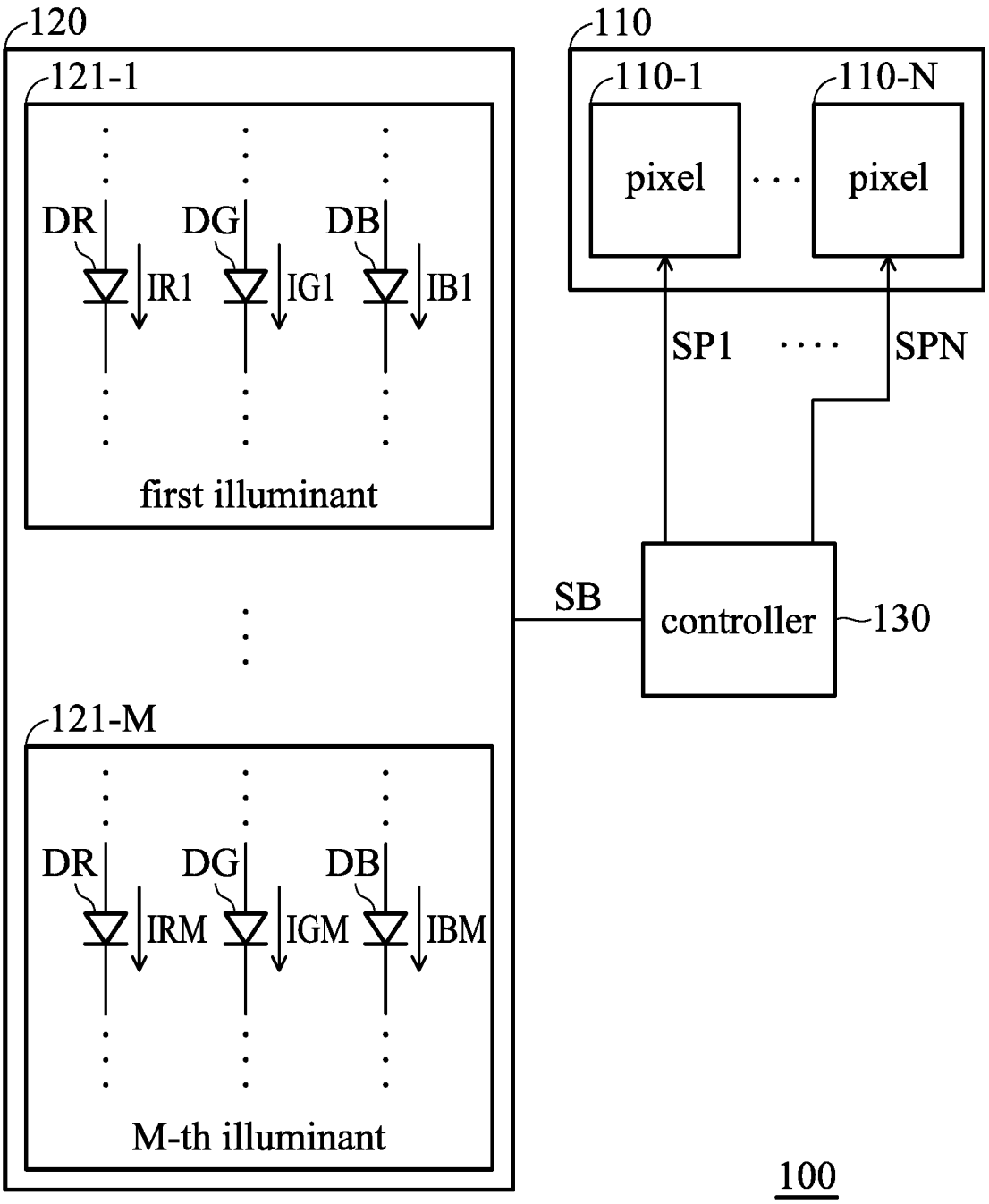
FIG. 1 is a block diagram of a display in accordance with an embodiment of the invention.

This description is made for the purpose of illustrating the general principles of the invention and should not be taken in a limiting sense. In addition, the present disclosure may repeat reference numerals and/or letters in the various examples. This repetition is for the purpose of simplicity and clarity and does not in itself dictate a relationship between the various embodiments and/or configurations discussed. The scope of the invention is best determined by reference to the appended claims.

It is understood that the following disclosure provides many different embodiments, or examples, for implementing different features of the application. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact.

FIG. 1 is a block diagram of a display in accordance with an embodiment of the invention. As shown in FIG. 1, the display 100 includes a display panel 110, a backlight module 120, and a controller 130. The display panel 110 includes a plurality of pixels 110-1, . . . , 110-N, in which each of the pixels 110-1, . . . , 110-N includes a pixel red gray-level value, a pixel green gray-level value, and a pixel blue gray-level value. Each of the pixels 110-1, . . . , 110-N adjusts a corresponding set of the pixel red gray-level value, the pixel green gray-level value, and the pixel blue gray-level value according to the first pixel signal SP1, . . . , the N-th pixel signal SPN.

The backlight module 120 is configured to illuminate the pixels 110-1, . . . , 110-N, which includes the first illuminant 121-1, . . . , the M-th illuminant 121-M, in which each of the first illuminant 121-1, . . . , the M-th illuminant 121-M includes a backlight red gray-level luminance, a backlight green gray-level luminance, and a backlight blue gray-level luminance. Each of the first illuminant 121-1, . . . , the M-th illuminant 121-M generates a different set of backlight red gray-level luminance, a backlight green gray-level luminance, and a backlight blue gray-level luminance according to a backlight signal SB.

Each of the first illuminant 121-1, . . . , the M-th illuminant 121-M includes at least one red illuminating unit DR, at least one green illuminating unit DG, and at least one blue illuminating unit DB. A first red-illumination current IR1, a first green-illumination current IG1, and a first blue-illumination current IB1 respectively flow through at least one red illuminating unit DR, at least one green illuminating unit DG, and at least one blue illuminating unit DB of the first illuminant 121-1 according to the backlight signal SB, and at least one red illuminating unit DR, at least one green illuminating unit DG, and at least one blue illuminating unit DB of the first illuminant 121-1 respectively generate red light, green light, and blue light; A M-th red-illumination current IRM, a M-th green-illumination current IGM, and a M-th blue-illumination current IBM respectively flow through at least one red illuminating unit DR, at least one green illuminating unit DG, and at least one blue illuminating unit DB of the M-th illuminant 121-M according to the backlight signal SB, and at least one red illuminating unit DR, at least one green illuminating unit DG, and at least one blue illuminating unit DB of the M-th illuminant 121-M respectively generate red light, green light, and blue light, and so on. It should be understood that, in other embodiments of the invention, the first illuminant 121-1 may include a plurality of red illuminating units DR, a plurality of green illuminating units DG, and a plurality of blue illuminating units DB. In other embodiments of the invention, the first illuminant 121-1 may include a plurality of white illuminating units.

According to an embodiment of the invention, the backlight red gray-level luminance, the backlight green gray-level luminance, and the backlight blue gray-level luminance of the first illuminant 121-1 are respectively determined by the magnitude of the first red-illumination current IR1, the first green-illumination current IG1, and the first blue-illumination current IB1; the backlight red gray-level luminance, the backlight green gray-level luminance, and the backlight blue gray-level luminance of the M-th illuminant 121-M are respectively determined by the magnitude of the M-th red-illumination current IRM, the M-th green-illumination current IGM, and the M-th blue-illumination current IBM, and so on.

According to another embodiment of the invention, the backlight red gray-level luminance, the backlight green gray-level luminance, and the backlight blue gray-level luminance of the illuminant may be respectively determined by the duty cycles of the first red-illumination current IR1, the first green-illumination current IG1, and the first blue-illumination current IB1. According to another embodiment of the invention, the backlight red gray-level luminance, the backlight green gray-level luminance, and the backlight blue gray-level luminance of the illuminant may be respectively determined by the duty cycles and the magnitude of the first red-illumination current IR1, the first green-illumination current IG1, and the first blue-illumination current IB1.

According to an embodiment of the invention, the controller 130 stores the sets of the pixel red gray-level value, the pixel green gray-level value, and the pixel blue gray-level value corresponding to the pixels 110-1, . . . , 110-N in a memory (not shown in FIG. 1). The controller 130 also respectively generates the first pixel signal SP1, . . . , the N-th pixel signal SPN according to the sets of the pixel red gray-level value, the pixel green gray-level value, and the pixel blue gray-level value corresponding to the pixels 110-1, . . . , 110-N which are stored in the memory. According to another embodiment of the invention, the controller 130 may control a plurality of pixels as an independently-adjusting pixel unit, and a set of pixel red gray-level value, the pixel green gray-level value, and the pixel blue gray-level value corresponds to a plurality of pixels and the burden of the memory is therefore mitigated. In addition, the charge-coupled device (CCD) may detect the chromaticity and luminance of each independently-adjusting pixel unit instead of the chromaticity and luminance of each pixel, so that the requirement of the CCD resolution could be mitigated.

According to an embodiment of the invention, the controller 130 is configured to store the sets of the backlight red gray-level luminance, the backlight green gray-level luminance, and the backlight blue gray-level luminance corresponding to each of the first illuminant 121-1, . . . , the M-th illuminant 121-M in the memory (not shown in FIG. 1). The controller 130 also generates the backlight signal SB according to the sets of the backlight red gray-level luminance, the backlight green gray-level luminance, and the backlight blue gray-level luminance corresponding to each of the first illuminant 121-1, . . . , the M-th illuminant 121-M. According to another embodiment of the invention, the controller 130 may take a plurality of illuminants as an independently-adjusting illuminating unit, and a set of the backlight red gray-level luminance, the backlight green gray-level luminance, and the backlight blue gray-level luminance corresponds to a plurality of illuminants and the burden of the memory is therefore mitigated. In addition, the CCD may detect the chromaticity and luminance at the center of each illuminating unit instead of the chromaticity and luminance at the center of each illuminant, so that the requirement of the CCD resolution could be mitigated.

In the following description, how the controller 130 controls the set of backlight red gray-level luminance, the backlight green gray-level luminance, and the backlight blue gray-level luminance corresponding to each of the first illuminant 121-1, . . . , the M-th illuminant 121-M or the set of the pixel red gray-level value, the pixel green gray-level value, and the pixel blue gray-level value corresponding to the pixels 110-1, . . . , 110-N for obtaining better displaying performance of the display 100 will be discussed in detail.

Figure 2:
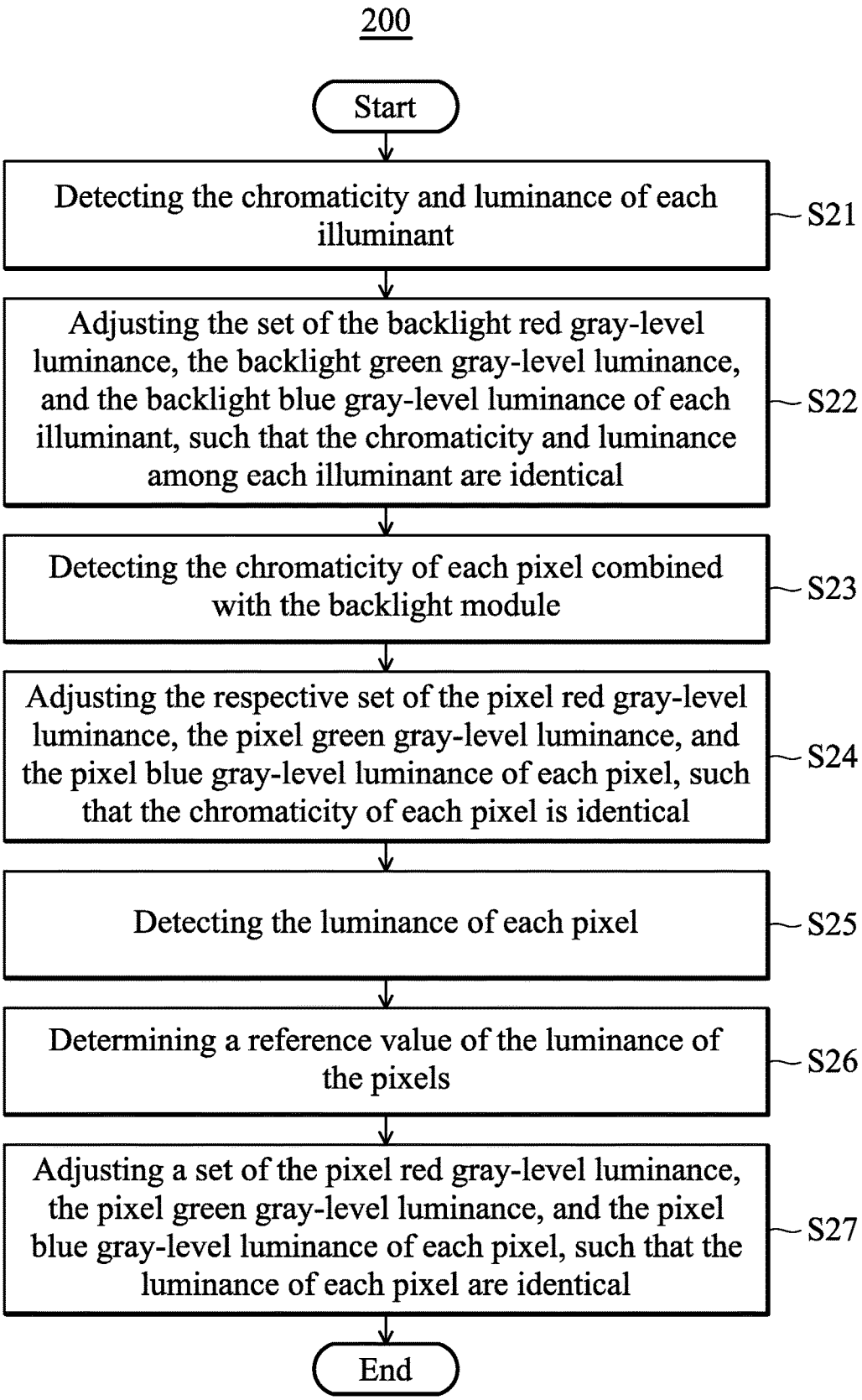
FIG. 2 is a flow chart of an adjustment method in accordance with an embedment of the invention.

FIG. 2 is a flow chart of an adjustment method in accordance with an embedment of the invention. The description of the adjustment method 200 in FIG. 2 will be accompanied by FIG. 1 for the convenience of explanation. As shown in FIG. 2, when the display 100 is manufactured, the chromaticity and luminance of each of the first illuminant 121-1, . . . , the M-th illuminant 121-M of the backlight module 120 are detected (Step S21). According to an embodiment of the invention, the CCD is used to detect the chromaticity and luminance of each of the first illuminant 121-1, . . . , the M-th illuminant 121-M of the backlight module 120. According to an embodiment of the invention, the CCD measures the chromaticity and luminance at the center of each of the first illuminant 121-1, . . . , the M-th illuminant 121-M. According to another embodiment of the invention, the CCD measures the chromaticity or luminance at the center of each of the first illuminant 121-1, . . . , the M-th illuminant 121-M. The invention is not limited thereto.

When the chromaticity and luminance of each of the first illuminant 121-1, . . . , the M-th illuminant 121-M of the backlight module 120 are determined, the controller 130 adjusts the sets of the backlight red gray-level luminance, the backlight green gray-level luminance, and the backlight blue gray-level luminance of the backlight module 120 according to the backlight signal SB for improving the uniformity of the chromaticity and luminance among each of the first illuminant 121-1, . . . , the M-th illuminant 121-M (Step S22). According to an embedment of the invention, the first illuminant 121-1, . . . , the M-th illuminant 121-M of the backlight module 120 respectively adjust their sets of the backlight red gray-level luminance, the backlight green gray-level luminance, and the backlight blue gray-level luminance according to the backlight signal SB for improving the uniformity of the chromaticity and luminance among each of the first illuminant 121-1, . . . , the M-th illuminant 121-M. According to another embodiment of the invention, the uniformity of the chromaticity or luminance among the first illuminant 121-1, . . . , the M-th illuminant 121-M may be improved after the chromaticity or luminance is separately determined.

It should be understood that, in one embodiment of the invention, improving the uniformity of the chromaticity and luminance among each of the first illuminant 121-1, . . . , the M-th illuminant 121-M includes an ideal case in which the chromaticity and luminance of the first illuminant 121-1, . . . , the M-th illuminant 121-M are exactly identical and a non-ideal case in which the chromaticity and luminance of the first illuminant 121-1, . . . , the M-th illuminant 121-M are not exactly identical. Therefore, improving the uniformity of the chromaticity and luminance among the first illuminant 121-1, . . . , the M-th illuminant 121-M indicates that 0%~10% difference of the luminance among the first illuminant 121-1, the M-th illuminant 121-M may be allowed, or 0%~0.3% difference of the chromaticity among the first illuminant 121-1, . . . , the M-th illuminant 121-M may be allowed.

That is, there are a maximum and a minimum of the luminance of the first illuminant 121-1, . . . , the M-th illuminant 121-M, and there is a luminance difference between the maximum and the minimum. The ratio of the absolute value of the luminance difference to the maximum does not exceed 10%. In addition, the chromaticity of each of the first illuminant 121-1, . . . , the M-th illuminant 121-M is expressed by the chromaticity coordinates. According to an embodiment of the invention, the X-coordinate in the chromaticity coordinates of the first illuminant 121-1, . . . , the M-th illuminant 121-M has a maximum and a minimum, in which there is a X-coordinate difference between the maximum and the minimum. The absolute value of the X-coordinate difference does not exceed 0.3% (i.e., 0.003). According to another embodiment of the invention, the Y-coordinate in the chromaticity coordinates of the first illuminant 121-1, . . . , the M-th illuminant 121-M has a maximum and a minimum, in which there is a Y-coordinate difference between the maximum and the minimum. The absolute value of the Y-coordinate difference does not exceed 0.3% (i.e., 0.003).

According to another embodiment of the invention, the first illuminant 121-1 of the backlight module 120 adjusts the first red-illumination current IR1 flowing through the red illuminating unit DR, the first green-illumination current IG1 flowing through the green illuminating unit DG, and the first blue-illumination current IB1 flowing through the blue illuminating unit DB, according to the backlight signal SB. The M-th illuminant 121-M of the backlight module 120 adjusts the M-th red-illumination current IRM flowing through the red illuminating unit DR, the M-th green-illumination current IGM flowing through the green illuminating unit DG, and the M-th blue-illumination current IBM flowing through the blue illuminating unit DB, according to the backlight signal SB.

After improving the uniformity of the chromaticity and/or luminance of the first illuminant 121-1, . . . , the M-th illuminant 121-M of the backlight module 120, the chromaticity of each of the pixels 110-1, . . . , 110-N combined with the backlight module 120 is detected (Step S23). According to an embodiment of the invention, after improving the uniformity of the chromaticity and luminance of the first illuminant 121-1, . . . , the M-th illuminant 121-M, the first illuminant 121-1, the M-th illuminant 121-M are configured to illuminate each of the pixels 110-1, . . . , 110-N, and the CCD is configured to determine the chromaticity.

In order to improve the uniformity of the chromaticity among each of the pixels 110-1, . . . , 110-N, the respective set of pixel red gray-level value, the pixel green gray-level value, and the pixel blue gray-level value corresponding to the pixels 110-1, . . . , 110-N is adjusted to improve the uniformity of the chromaticity among each of the pixels 110-1, . . . , 110-N (Step S24). According to an embodiment of the invention, the uniformity of chromaticity among each of the pixels 110-1, . . . , 110-N is improved by lowering the respective maximum pixel gray-level value of the pixels 110-1, . . . , 110-N (i.e., any one, two, or three of the pixel red gray-level value, the pixel green gray-level value, and the pixel blue gray-level value).

It should be understood that, in one embodiment of the invention, improving the uniformity of chromaticity among each of the pixels 110-1, . . . , 110-N includes an ideal case in which the chromaticity of each of the pixels 110-1, . . . , 110-N is exactly identical and a non-ideal case in which the chromaticity of each of the pixels 110-1, . . . , 110-N is not exactly identical. Therefore, improving the uniformity of the chromaticity among each of the pixels 110-1, . . . , 110-N indicates that 0~0.15% difference of the chromaticity among the pixels 110-1, . . . , 110-N may be allowed. That is, the chromaticity of each of the pixels 110-1, . . . , 110-N is expressed by the chromaticity coordinates. According to an embodiment of the invention, the X-coordinate in the chromaticity coordinates of the pixels 110-1, . . . , 110-N has a maximum and a minimum, in which there is a the X-coordinate difference between the maximum and the minimum. The absolute value of the X-coordinate difference does not exceed 0.15% (i.e., 0.0015). According to another embodiment of the invention, the Y-coordinate in the chromaticity coordinates of the pixels 110-1, . . . , 110-N has a maximum and a minimum, in which there is a Y-coordinate difference between the maximum and the minimum. The absolute value of the Y-coordinate difference does not exceed 0.15% (i.e., 0.0015).

In addition, the luminance of each of the pixels 110-1, . . . , 110-N of the display 100 is detected (Step S25). According to an embodiment of the invention, a CCD is configured to detect the chromaticity of each of the pixels 110-1, . . . , 110-N, and the luminance of one of the pixels 110-1, . . . , 110-N is taken as a reference value (Step S26). The luminance of other pixels is adjusted toward reference value.

According to an embodiment of the invention, when the CCD is configured to detect the chromaticity of each pixel of the display 100, a relatively small value is determined to be a reference value according to the luminance of each of pixels 110-1, . . . , 110-N. According to another embodiment of the invention, the reference value is the minimum of the luminance of the pixels 110-1, . . . , 110-N. According to other embodiments of the invention, the reference value is 90% of the maximum of the luminance of the pixels 110-1, . . . , 110-N. In other words, the designers may determine the reference value on their own. The invention is not limited thereto.

Then, the respective maximal gray-level values (i.e., the sets of the pixel red gray-level value, the pixel green gray-level value, and the pixel blue gray-level value) of the pixels 110-1, . . . , 110-N are adjusted once again by a gray-level transformation equation, and the luminance of each of the pixels 110-1, . . . , 110-N is aligned to the reference value for further improving the uniformity of the chromaticity of each of the pixels 110-1, . . . , 110-N (Step S27).

It should be understood that, in one embodiment of the invention, improving the uniformity of the luminance among each of the pixels 110-1, . . . , 110-N includes an ideal case the luminance among each of the pixels 110-1, . . . , 110-N is exactly identical and a non-ideal case that the luminance among each of the pixels 110-1, . . . , 110-N is not exactly identical. Therefore, improving the uniformity of the luminance among each of the pixels 110-1, . . . , 110-N indicates that 0~5% difference of the luminance among the pixels 110-1, . . . , 110-N may be allowed. That is, the luminance of each of the pixels 110-1, . . . , 110-N has a maximum and a minimum, and there is a luminance difference between the maximum and the minimum. The ratio of the absolute value of the luminance difference to the maximum doesn't exceed 5%.

According to another embodiment of the invention, after improving the uniformity of the chromaticity and/or luminance of the first illuminant 121-1, . . . , the M-th illuminant 121-M of the backlight module 120, the uniformity of the luminance among each of the pixels 110-1, . . . , 110-N is merely improved, or the uniformity of the chromaticity among each of the pixels 110-1, . . . , 110-N is merely improved. According to another embodiment of the invention, the chromaticity or luminance of the first illuminant 121-1, . . . , the M-th illuminant 121-M of the backlight module 120 is not improved, but the uniformity of chromaticity or luminance among each of the pixels 110-1, . . . , 110-N is improved. According to another embodiment of the invention, the uniformity of the chromaticity or luminance of the first illuminant 121-1, . . . , the M-th illuminant 121-M of the backlight module 120 is improved, but the uniformity of chromaticity or luminance among each of the pixels 110-1, . . . , 110-N is not improved. The various adjustment methods discussed above may be selected according to the requirement of the clients, and the steps may be modified according to the client's requirements as well. The invention is not limited thereto.

According to an embodiment of the invention, the pixels 110-1, . . . , 110-N adjust the respective shading levels to the red light, green light, and blue light according to the first pixel signal SP1, . . . , the N-th pixel signal SPN to achieve the purpose of adjusting the sets of the pixel red gray-level value, the pixel green gray-level value, and the pixel blue gray-level value.

Figure 3:
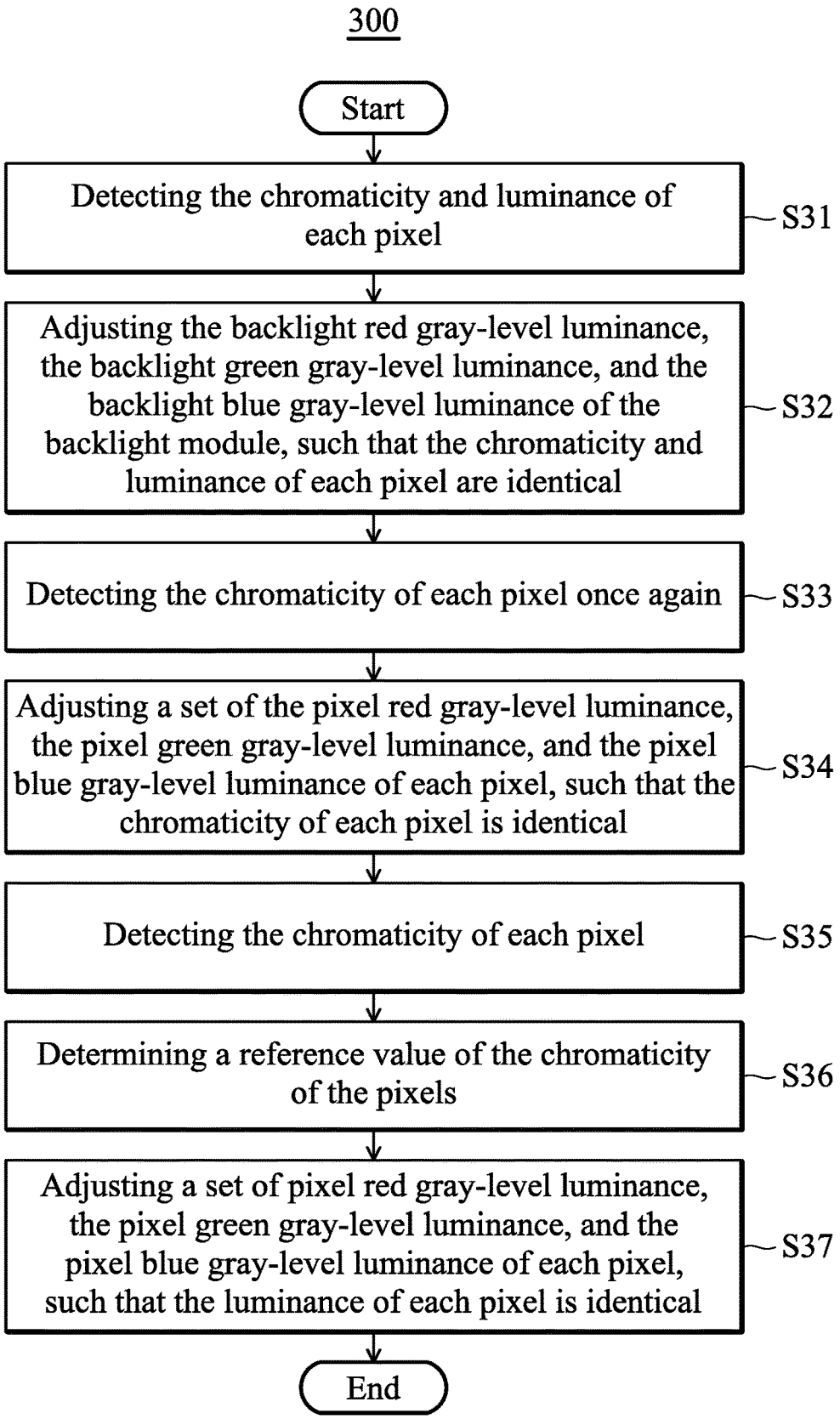
FIG. 3 is a flow chart of an adjustment method in accordance with another embedment of the invention.

FIG. 3 is a flow chart of an adjustment method in accordance with another embedment of the invention. The description of the adjustment method 300 in FIG. 3 will be accompanied by FIG. 1 for the convenience of explanation. As shown in FIG. 3, when the display 100 is manufactured, the chromaticity and luminance of each of the pixels 110-1, . . . , 110-N of the display 100 combined with the backlight module 120 are detected (Step S31). According to an embodiment of the invention, when executing Step S31, the pixel red gray-level value, the pixel green gray-level value, and the pixel blue gray-level value of each of the pixels 110-1, . . . , 110-N are set to be the maximal gray-level value, and the chromaticity and luminance of the display 100 are then detected by the CCD, and the CCD is able to detect the difference of the chromaticity and luminance among each of the first illuminant 121-1, . . . , the M-th illuminant 121-M. According to an embedment of the invention, the CCD measures the chromaticity and luminance at the center of each of the first illuminant 121-1, . . . , the M-th illuminant 121-M. According to another embodiment of the invention, the CCD measures the chromaticity or luminance at the center of each of the first illuminant 121-1, . . . , the M-th illuminant 121-M.

After the chromaticity and luminance of the first illuminant 121-1, . . . , the M-th illuminant 121-M are determined through the pixels, the controller 130 improves the uniformity of the chromaticity and luminance of each of the first illuminant 121-1, . . . , the M-th illuminant 121-M by adjusting the sets of the backlight red gray-level luminance, the backlight green gray-level luminance, and the backlight blue gray-level luminance of the backlight module 120 according to the backlight signal SB (Step S32). According to an embodiment of the invention, the first illuminant 121-1, . . . , the M-th illuminant 121-M adjust the respective sets of the backlight red gray-level luminance, the backlight green gray-level luminance, and the backlight blue gray-level luminance according to the backlight signal SB to improve the uniformity of the chromaticity and luminance among each of the first illuminant 121-1, . . . , the M-th illuminant 121-M. According to another embodiment of the invention, the chromaticity or luminance may be separately determined to improve the uniformity of the chromaticity or luminance among each of the first illuminant 121-1, . . . , the M-th illuminant 121-M.

It should be understood that, in one embodiment of the invention, improving the uniformity of the chromaticity and luminance among each of the first illuminant 121-1, . . . , the M-th illuminant 121-M includes an ideal case in which the chromaticity and luminance of the first illuminant 121-1, . . . , the M-th illuminant 121-M are exactly identical and the non-ideal case in which the chromaticity and luminance of the first illuminant 121-1, . . . , the M-th illuminant 121-M are not exactly identical. Therefore, improving the uniformity of the chromaticity and luminance among each of the first illuminant 121-1, . . . , the M-th illuminant 121-M indicates that 0~10% difference of the luminance among each of the first illuminant 121-1, . . . , the M-th illuminant 121-M may be allowed, or 0~0.3% difference of the chromaticity among each of the first illuminant 121-1, . . . , the M-th illuminant 121-M may be allowed. Since the definition of the differences is described in detail above, it will not be repeated.

According to another embodiment of the invention, the first illuminant 121-1 of the backlight module 120 adjusts the first red-illumination current IR1 flowing through the red illuminating unit DR, the first green-illumination current IG1 flowing through the green illuminating unit DG, and the first blue-illumination current IB1 flowing through the blue illuminating unit DB according to the backlight signal SB. The M-th illuminant 121-M of the backlight module 120 adjusts the M-th red-illumination current IRM flowing through the red illuminating unit DR, the M-th green-illumination current IGM flowing through the green illuminating unit DG, and the M-th blue-illumination current IBM flowing through the blue illuminating unit DB according to the backlight signal SB.

After improving the uniformity of either one or both of the chromaticity and luminance of the first illuminant 121-1, . . . , the M-th illuminant 121-M of the backlight module 120, the chromaticity of the pixels 110-1, . . . , 110-N of the display 100 is detected once again (Step S33). The set of the pixel red gray-level value, the pixel green gray-level value, and the pixel blue gray-level value of each of the pixels

110-1, . . . , 110-N is adjusted to improve the uniformity of the chromaticity among each of the pixels 110-1, . . . , 110-N (Step S34). According to an embodiment of the invention, the uniformity of the chromaticity among each of the pixels 110-1, . . . , 110-N is improved by lowering the respective maximal gray-level value (i.e., either one, two, or three of the pixel red gray-level value, the pixel green gray-level value, and the pixel blue gray-level value) of the pixels 110-1, . . . , 110-N.

It should be understood that, in one embodiment of the invention, improving the uniformity of the chromaticity among each of the pixels 110-1, . . . , 110-N includes an ideal case in which the luminance of each of the pixels 110-1, . . . , 110-N is exactly identical and a non-ideal case in which the luminance of each of the pixels 110-1, . . . , 110-N is not exactly identical. Therefore, improving the uniformity of the chromaticity among each of the pixels 110-1, . . . , 110-N indicates that 0~0.15% difference of the chromaticity among the pixels 110-1, . . . , 110-N may be allowed. Since the definition of the difference is described in detail above, it will not be repeated.

Then, the luminance of each of the pixels 110-1, . . . , 110-N of the display 100 is detected (Step S35). According to an embodiment of the invention, a CCD is configured to detect the chromaticity of each pixel in the display 100. In addition, the chromaticity of one of the pixels 110-1, . . . , 110-N is taken as a reference value, and the chromaticity of the other pixels is adjusted toward the reference value.

According to an embodiment of the invention, when the chromaticity of each pixel in the display 100 is detected by the CCD, a relatively small value is taken as a reference value according to the chromaticity of each of the pixels 110-1, . . . , 110-N. According to another embodiment of the invention, the reference value is the minimal chromaticity of the pixels 110-1, . . . , 110-N. According to other embodiments of the invention, the reference value is 90% of the maximal chromaticity of the pixels 110-1, . . . , 110-N. In other words, the designers may determine the reference value on their own. The invention is not limited thereto.

Then, the respective maximal gray-level values (i.e., the sets of the pixel red gray-level value, the pixel green gray-level value, and the pixel blue gray-level value) of the pixels 110-1, . . . , 110-N are adjusted once again by a gray-level transformation equation, and the luminance of each of the pixels 110-1, . . . , 110-N is aligned to the reference value for further improving the uniformity of the chromaticity of each of the pixels 110-1, . . . , 110-N (Step S37).

It should be understood that, in one embodiment of the invention, improving the uniformity of the luminance among each of the pixels 110-1, . . . , 110-N includes an ideal case in which the luminance of each of the pixels 110-1, . . . , 110-N is exactly identical and a non-ideal case in which the luminance of each of the pixels 110-1, . . . , 110-N is not exactly identical. Therefore, improving the uniformity of the luminance among each of the pixels 110-1, . . . , 110-N indicates that 0~5% difference of the luminance among the pixels 110-1, . . . , 110-N may be allowed. Since the definition of the difference is described in detail above, it will not be repeated.

According to another embodiment of the invention, after improving the uniformity of the chromaticity and/or luminance of the first illuminant 121-1, . . . , the M-th illuminant 121-M of the backlight module 120, the uniformity of the luminance among each of the pixels 110-1, . . . , 110-N is merely improved, or the uniformity of the chromaticity among each of the pixels 110-1, . . . , 110-N is merely improved. According to another embodiment of the invention, the chromaticity or luminance of the first illuminant 121-1, . . . , the M-th illuminant 121-M of the backlight module 120 is not improved, but the uniformity of the chromaticity or luminance among each of the pixels 110-1, . . . , 110-N is improved. According to another embodiment of the invention, the uniformity of the chromaticity or luminance of the first illuminant 121-1, the M-th illuminant 121-M of the backlight module 120 is improved, but the uniformity of the chromaticity or luminance among each of the pixels 110-1, . . . , 110-N is not improved. The various adjustment methods discussed above may be selected according to the requirement of the clients, and the steps may be modified according to the client's requirements as well. The invention is not limited thereto.

According to an embodiment of the invention, the pixels 110-1, . . . , 110-N adjust the respective shading levels to the red light, green light, and blue light according to the first pixel signal SP1, . . . , the N-th pixel signal SPN to achieve the purpose of adjusting the sets of the pixel red gray-level value, the pixel green gray-level value, and the pixel blue gray-level value.

After the calibration of the adjustment method 200 in FIG. 2 and the adjustment method 300 in FIG. 3, either two of the first illuminant 121-1, . . . , the M-th illuminant 121-M have different sets of the backlight red gray-level luminance, the backlight green gray-level luminance, and the backlight blue gray-level luminance, which are different from each other, and either two of the pixels 110-1, . . . , 110-N have different sets of the pixel red gray-level value, the pixel green gray-level value, and the pixel blue gray-level value, which are different from each other.

For further explanation, when an image signal with a single chromaticity and luminance, such as a pure color screen with a uniform luminance, is input to the display 100, the controller generates the corresponding backlight signal, and at least two of the illuminants generate different sets of the backlight red gray-level luminance, the backlight green gray-level luminance, and the backlight blue gray-level luminance according to the backlight signal.

Alternatively, the controller generates the corresponding pixel signal, and the sets of pixel red gray-level value, the pixel green gray-level value, and the pixel blue gray-level value corresponding to at least two pixels are different to compensate the phenomenon of the non-uniformity of the chromaticity or luminance among the red illuminating unit DR, the green illuminating unit DG, and the blue illuminating unit DB in each illuminant. It should be understood that the invention is not limited to input an image signal with a single chromaticity and luminance to the display. That is, the invention is not intended to limit the content and type of the input image signal.

For explaining the invention in detail, the following embodiments are illustrated, but the invention is not limited to the embodiments. 8-bit of gray-level value is illustrated in the following. However, 10-bit, or even 12-bit, of gray-level value could be required in the reality. Before executing the adjustment method 200, the maximal gray-level value of the N-th pixel is a set of (255, 255, 255), in which each value of the set corresponds to the pixel red gray-level value, the pixel green gray-level value, and the pixel blue gray-level value, and the luminance is Yn. After adjusting the chromaticity by Step S24 of the adjustment method 200, the maximal gray-level value of the N-th pixel is modified to be (255, 250, 252) which is defined as (Rn', Gn', Bn'), and the luminance is Yn', i.e., Yn>Yn'.

It is assumed that the display 100 has 100 pixels, the luminance of each pixel before the chromaticity is adjusted is Y1~Y100, and the luminance of each pixel after the chromaticity is adjusted is Y1'~Y100'. In order to improve the uniformity of the luminance of the 100 pixels, Step S25 and Step S26 are utilized to discover the minimal luminance Min, in which the minimal luminance Min is the minimum of Y1'~Y100'. In the phase of improving the uniformity of chromaticity, the luminance is updated to (Rn', Gn', Bn'). In the phase of improving the uniformity of luminance, the luminance is further updated to (Rn", Gn", Bn") by the gray-level transformation equation, in which Rn", Gn", and Bn" are respectively expressed by Eq. 1, Eq. 2, and Eq. 3, and gamma_r, gamma_g, and gamma_b are respectively the gamma indexes of the red light, green light, and the blue light. According to an embodiment of the invention, the gamma indexes of the red light, the green light, and the blue light are both 2.2. According to other embodiments of the invention, the gamma indexes of the red light, the green light, and the blue light are selected from a look-up table (LUT).

$$Rn''=Rn'*(\mathrm{Min}/Yn')\hat{}(1/\mathrm{gamma_}r) \quad \text{(Eq. 1)}$$

$$Gn''=Gn'*(\mathrm{Min}/Yn')\hat{}(1/\mathrm{gamma_}g) \quad \text{(Eq. 2)}$$

$$Bn''=Bn'*(\mathrm{Min}/Yn')\hat{}(1/\mathrm{gamma_}b) \quad \text{(Eq. 3)}$$

After the calibration of the adjustment method 200, the uniformities of the luminance and chromaticity of the display 100 are improved, such that the problem of Mura in a display could be improved or the yield of the product could be increased.

After the calibration of the adjustment method 200, at least two of the first illuminant 121-1, . . . , the M-th illuminant 121-M of the backlight module 120 have sets of the backlight red gray-level luminance, the backlight green gray-level luminance, and the backlight blue gray-level luminance, which are different from each other, and at least two of the pixels 110-1, . . . , 110-N have sets of the pixel red gray-level value, the pixel green gray-level value, and the pixel blue gray-level value, which are different from each other. Therefore, the display performance of the pixels 110-1, . . . , 110-N combined with the backlight module 120 in the display 100 is better.

The various embodiments discussed above can be mixed to use without departing from the scope and spirit of this invention, such as part of characteristics of an embodiment can be combined with part of characteristic of another embodiment to be another embodiment.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A display, comprising:

a plurality of pixels, wherein each of the plurality of pixels comprises a pixel red gray-level value, a pixel green gray-level value, and a pixel blue gray-level value, wherein each of the plurality of pixels adjusts a set of the pixel red gray-level value, the pixel green gray-level value, and the pixel blue gray-level value according to a corresponding pixel signal so that a difference of the luminance between luminance generated by one of the plurality of pixels and luminance generated by another of the plurality of among the pixels is between 0% and 5%, wherein the luminance generated by each of the plurality of pixels comprises a pixel red luminance, a pixel green luminance, and a pixel blue luminance, wherein the pixel signal corresponds to an image signal with a single chromaticity and single luminance;

a controller, generating the pixel signal, and wherein at least two sets of the pixel red gray-level value, the pixel green gray-level value, and the pixel blue gray-level value are different from each other; and a backlight module, configured to illuminate the pixels and comprising a plurality of illuminants, wherein each of the illuminants comprises:

a red illuminating unit, generating red light by a red-illumination current according to the backlight signal, wherein the backlight red gray-level value is determined by the red-illumination current;

a green illuminating unit, generating green light by a green-illumination current according to the backlight signal, wherein the green gray-level value is determined by the green-illumination current; and a blue illuminating unit, generating blue light by a blue-illumination current according to the backlight signal, wherein the red illuminating unit, the green illuminating unit, and the blue illuminating unit further adjust, according to the backlight signal, magnitudes of the red-illumination current, the green-illumination current, and the blue-illumination current to determine a backlight red gray-level luminance, a backlight green gray-level luminance, and a backlight blue gray-level luminance, and a difference between chromaticity generated by one of the plurality of backlight illuminants and chromaticity generated by another of the plurality of backlight illuminants is between 0 and 0.3%.

2. The display of claim 1, wherein at least one of the pixel red gray-level value, the pixel green gray-level value, and the pixel blue gray-level value in the at least two sets is different.

3. The display of claim 1, wherein each of the illuminants comprises a backlight red gray-level value, a backlight green gray-level value, and a backlight blue gray-level value.

4. The display of claim 3, wherein the controller generates a backlight signal, and at least two of the illuminants generate at least two different sets of the backlight red gray-level value, the backlight green gray-level value, and the backlight blue gray-level value according to the backlight signal.

5. The display of claim 1, wherein the blue gray-level value is determined by the blue-illumination current, wherein the controller utilizes the backlight signal to achieve a difference between luminance generated by one of the plurality of backlight illuminants and luminance generated by another of the plurality of backlight illuminants between 0 and 10%, wherein the luminance generated by each of the plurality backlight illuminants comprises a backlight red luminance, a backlight green luminance, and a backlight blue luminance.

6. The display of claim 1, wherein the red illuminating unit, the green illuminating unit, and the blue illuminating unit further adjust, according to the backlight signal, duty cycles of the red-illumination current, the green-illumination current, and the blue-illumination current to determine a backlight red gray-level luminance, a backlight green gray-level luminance, and a backlight blue gray-level luminance, and a difference between chromaticity generated by one of the plurality of backlight illuminants and chromaticity generated by another of the plurality of backlight illuminants is between 0 and 0.3%.

7. The display of claim 1, wherein the red illuminating unit, the green illuminating unit, and the blue illuminating unit further adjust, according to the backlight signal, duty cycles and magnitudes of the red-illumination current, the green-illumination current, and the blue-illumination current to determine a backlight red gray-level luminance, a backlight green gray-level luminance, and a backlight blue gray-level luminance, and a difference between chromaticity generated by one of the plurality of backlight illuminants and chromaticity generated by another of the plurality of backlight illuminants is between 0 and 0.3%.

* * * * *